United States Patent [19]

Farkas

[11] Patent Number: 4,679,618

[45] Date of Patent: Jul. 14, 1987

[54] DRAINCOCK AND DRAIN HOLE FOR A LIQUID VESSEL

[75] Inventor: Frank J. Farkas, Getzville, N.Y.

[73] Assignee: General Motors Corporation, Detroit, Mich.

[21] Appl. No.: 930,110

[22] Filed: Nov. 13, 1986

[51] Int. Cl.[4] ..... F16F 1/34

[52] U.S. Cl. ..... 165/71; 251/144; 251/353; 251/904

[58] Field of Search ..... 165/71; 251/144, 353, 251/904

[56] References Cited

U.S. PATENT DOCUMENTS 2,961,169 11/1960 Nyden ..... 251/353 X 3,744,558 7/1973 Childress ..... 165/71

4,449,692 5/1984 Rhodes ..... 165/71 X 4,612,977 9/1986 Hayashi et al. ..... 165/71

FOREIGN PATENT DOCUMENTS 2409367 10/1974 Fed. Rep. of Germany ..... 165/71

*Primary Examiner*—Albert W. Davis, Jr.
*Assistant Examiner*—Richard R. Cole
*Attorney, Agent, or Firm*—R. L. Phillips

[57] ABSTRACT

A draincock and drain hole for a motor vehicle radiator have a cooperative relationship that effects sealed closure of the drain hole with an o-ring and both locks the draincock in its closed position and retains same in the drain hole in an open position.

2 Claims, 3 Drawing Figures

DRAINCOCK AND DRAIN HOLE FOR A LIQUID VESSEL

TECHNICAL FIELD

This invention relates to draincocks and more particularly to a draincock and drain hole for a liquid vessel such as a motor vehicle radiator.

BACKGROUND OF THE INVENTION

Liquid vessels such as motor vehicle radiators and the like typically have a draincock that threads into a drain hole and has a washer type seal that requires a certain draincock torque specification to effect good sealing. Furthermore, these draincocks are normally not positively attached to the vessel when unthreaded from the drain hole to open same and as a result may be misplaced or lost.

SUMMARY OF THE INVENTION

The present invention avoids any such torque requirement by providing a draincock and drain hole arrangement wherein the draincock snaps in place to close the drain hole and seal same with an o-ring and, moreover, is retained in the drain hole when pulled to open same.

DESCRIPTION OF THE PREFERRED EMBODIMENT

These and other objects, advantages and features of the invention will become more apparent from the following description and drawing in which.

Figure 1:
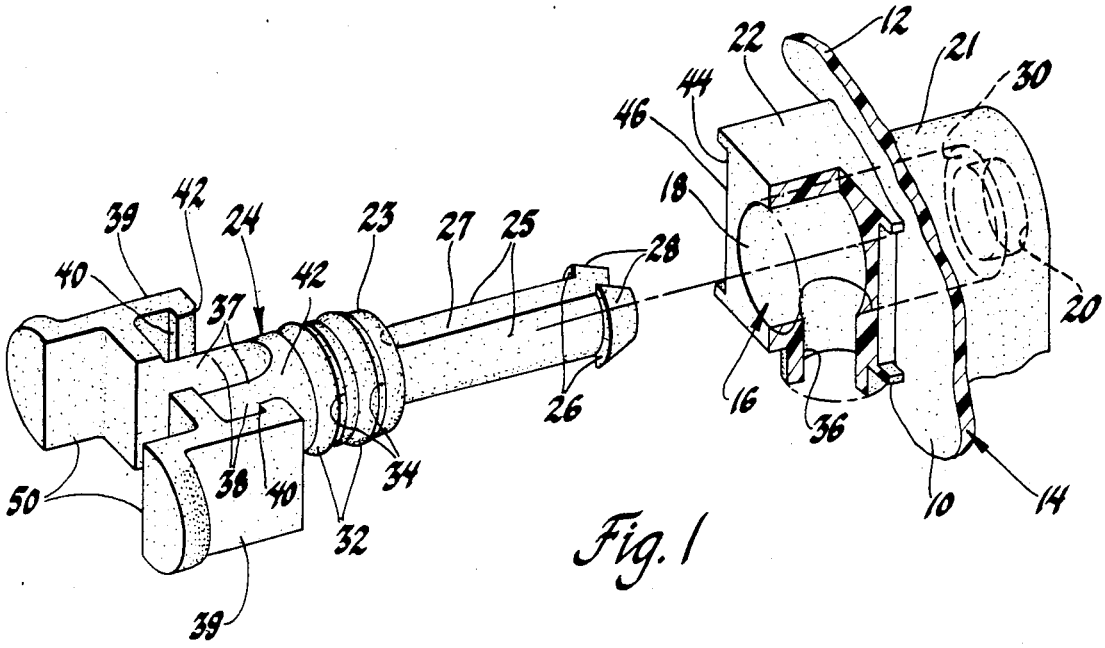
FIG. 1 is an exploded view of the draincock and drain hole according to the present invention as employed in a motor vehicle radiator.

Referring to the drawing wherein the same reference numbers are used to identify the same parts throughout the several views, there is shown a portion of a side wall 10 of a plastic side tank 12 of a cross-flow type motor vehicle radiator 14 that contains coolant for a vehicle's engine (not shown) and is conventional except for drainage thereof as will now be described. To the latter end, the tank side wall 10 near the bottom thereof at a low point in the radiator is formed with a stepped cylindrical bore 16 having a large diameter portion 18 that extends from the exterior of the tank and a small diameter portion 20 that extends to the interior of the tank. The axial dimension of the small diameter bore portion is the normal thickness of the tank wall while that of the large diameter bore portion is substantially larger as provided by an inward and outward wall projection 21 and 22 to accommodate the cylindrical body 23 of an injection molded plastic draincock 24.

Figure 3:
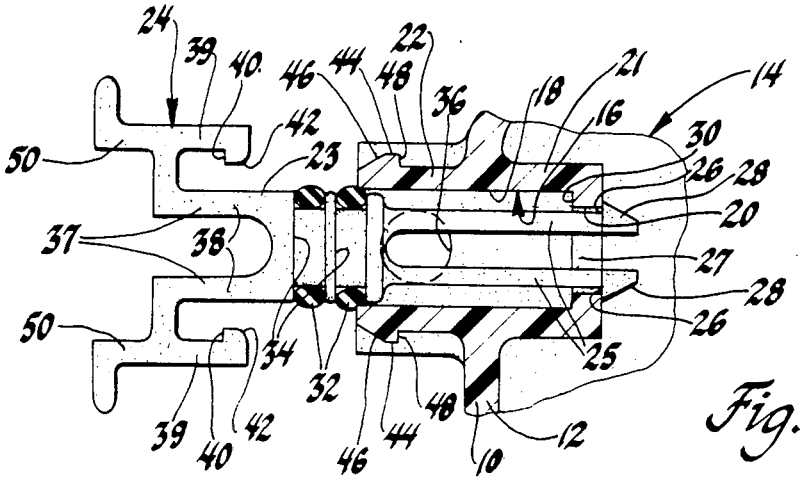
FIG. 3 is a view similar to FIG. 2 but with the draincock in its open position.

The cylindrical body 23 of the draincock is receivable with a slip fit in the large diameter bore portion 18 and has a pair of cantilever retaining arms 25 of partially circular uniform cross section that extend axially from one end thereof and parallel to each other. The arms 25 are located diagonally opposite each other and each have a radially outwardly extending hook 26 and a ramp 28 at the end thereof. The ramps 28 are of partially conical shape and arranged to contact with the radial step 30 between the bore portions 16 and 18 on inwardly forced movement of the draincock into the stepped bore to deflect the arms radially inward to allow the hooks 26 and thereby the arms to pass through the small diameter bore portion into the interior of the tank. The hooks 26 upon clearing the small diameter bore portion 20 allow the arms to resume their normal state while extending through but not blocking this bore portion by virtue of the longitudinal space 27 between the arms 25 and positioning the hooks for contact with the interior side of the tank wall as shown in FIG. 3 to prevent removal of the draincock from the drain hole. At least one and possibly two o-rings 32 as shown are mounted in separate annular grooves 34 in the cylindrical body of the draincock to prevent leakage therepast in the large diameter bore portion.

Figure 2:
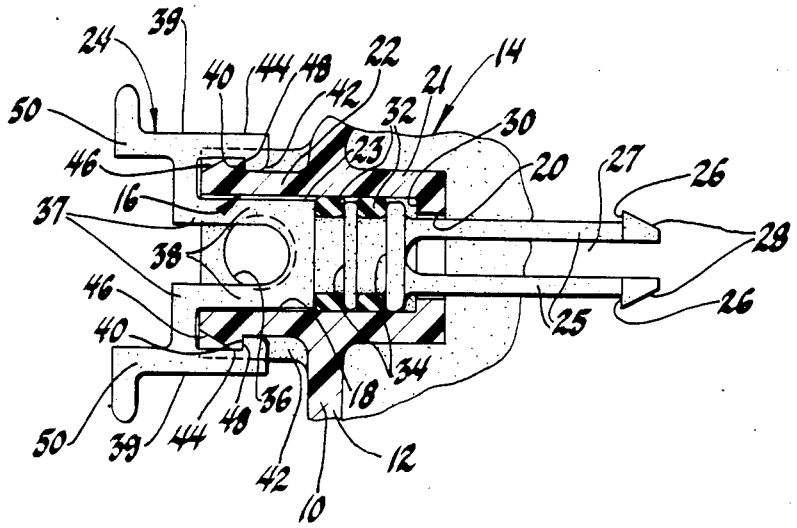
FIG. 2 is a longitudinal sectional view of the parts in FIG. 1 assembled with the draincock in its closed position.

A hole 36 formed in the outward extension 22 of the tank wall intersects at right angles with the large diameter bore portion 18 for connecting same with the exterior of the tank while the draincock is retained in the drain hole in its open position (FIG. 3). To this end, the length of the retaining arms 25 measured from the cylindrical body to their hook 26 is determined so that the draincock while remaining retained thereby is movable between (1) a closed position blocking the radial hole 36 with the cylindrical body 23 and positioning the sealing means 32 between the radial hole and the small diameter bore portion 20 to sealingly close the drain hole as shown in FIG. 2 and (2) an open position uncovering the externally open radial hole to the large diameter bore portion 18 and through the small diameter bore portion 20 in the space 27 between the arms to the interior of the tank as shown in FIG. 3.

The closed position is maintained by a pair of cantilever locking arms 37 that extend from the opposite or exterior end of the cylindrical body 23 of the draincock. The arms 37 each have a beam section 38 like the retaining arms 25 and are similarly located diagonally opposite each other and extend axially and parallel to each other but then have a reverse bend 39 with a radially inwardly extending lock engaging hook 40 and a lock engaging ramp 42 at their end that are located radially outward of the large diameter bore portion 18. Locking detents 44 in the form of transverse shoulders are formed radially outward of the drain hole at diagonally opposite locations on the outward extension 22 of the tank wall. The lock engaging ramps 42 on the draincock are arranged to contact a ramped face 46 of these detents on inwardly forced draincock movement to deflect the locking arms radially outward so that their hooks clear the respective detents. On clearing the detents, the arms 37 then resume their normal state as shown if FIG. 2 to position the hooks to contact the back side 48 of the detents 44 to thus lock the draincock 24 in its closed position. Unlocking is facilitated by release arms 50 that extend axially and then radially outward from the respective reverse bends 39. To unlock, manual force is simply applied in the radially inward direction on the release arms so as to deflect the locking hooks outward from the detents to allow movement of the draincock to its open position while remaining retained by the retaining arms 25.

The above described embodiment is illustrative of the invention which may be modified within the scope of the appended claims.

The embodiments of the invention in which an exclusive property or privilege is claimed are defined as follows:

1. A draincock and drain hole for a liquid vessel such as a motor vehicle radiator characterized by the hole including a stepped cylindrical bore with a large diameter portion that opens to the exterior of the vessel and a small diameter portion that opens to the interior of the vessel, the draincock having a cylindrical body that is receivable with a slip fit in the large diameter bore portion, at least one cantilever retaining arm extending from one end of the cylindrical body having a hook and a ramp at the end thereof, the ramp arranged to contact with a radial step between the bore portions on inwardly forced movement of the draincock to deflect the respective arm inward to allow the hook and thereby the arm to pass through the small diameter bore portion and whereafter the hook upon clearing the small diameter bore portion allows the arm to resume its normal state while extending through but not blocking the small diameter bore portion and positioning the hook for contact with the vessel about the hole to prevent removal of the draincock from the hole, seal means mounted on the cylindrical body for preventing leakage therepast in the large diameter bore portion, the vessel having a hole intersecting with the large diameter bore portion for connecting same with the exterior of the vessel, the length of the retaining arm measured from the cylindrical body to the hook being determined so that the draincock while remaining retained by the hook is movable between an open position uncovering the hole to the large diameter bore portion and through the small bore portion past the retaining arm to the interior of the vessel and a closed position blocking the hole with the cylindrical body and positioning the seal means between the radial hole and the small diameter bore portion to sealingly close the drain hole, and at lest one cantilever locking arm extending from the other end of the cylindrical body having a locking hook and a lock engaging ramp, a detent formed on the exterior of the vessel, the lock engaging ramp being arranged to contact with the detent on inwardly forced draincock movement to deflect the locking arm outward so that the locking hook clears the detent and whereafter the locking arm resumes its normal state to position the locking hood to contact the detent to lock the draincock in its closed position and whereafter the locking arm is manually deflectable outward to release from the detent to allow movement of the draincock to its open position while remaining retained in the stepped bore by the retaining arm.

2. A draincock and drain hole for a liquid vessel such as a motor vehicle radiator characterized by the hole including a stepped cylindrical bore with a large diameter portion that opens to the exterior of the vessel and a small diameter portion that opens to the interior of the vessel, the draincock being of one-piece construction having a cylindrical body that is receivable with a slip fit in the large diameter bore portion, a pair of cantilever retaining arms extending from one end of the cylindrical body each having a hook and a ramp at the end thereof, the ramps arranged to contact with a radial step between the bore portions on inwardly forced movement of the draincock to deflect their respective arm inward to allow the hooks and thereby the arms to pass through the small diameter bore portion and whereafter the hooks upon clearing the small diameter bore portion allow the arms to resume their normal state while extending through but not blocking the small diameter bore portion and positioning the hooks for contact with the vessel about the hole to prevent removal of the draincock from the hole, seal means mounted on the cylindrical body for preventing leakage therepast in the large diameter bore portion, the vessel having a hole intersecting with the large diameter bore portion for connecting same with the exterior of the vessel, the length of the retaining arms measured from the cylindrical body to their hook being determined so that the draincock while remaining retained by the hooks is movable between an open position uncovering the hole to the large diameter bore portion and through the small bore portion and between the retaining arms to the interior of the vessel and a closed position blocking the hole with the cylindrical body and positioning the seal means between the radial hole and the small diameter bore portion to sealingly close the drain hole, and a pair of cantilever locking arms extending from the other end of the cylindrical body each having a locking hook and a lock engaging ramp, a pair of detents formed on the exterior of the vessel, the lock engaging ramps being arranged to contact with the respective detents on inwardly forced draincock movement to deflect their respective locking arm outward so that the locking hooks clear the respective detents and whereafter the locking arms resume their normal state to position the locking hooks to contact the detents to lock the draincock in its closed position and whereafter the locking arms are manually deflectable outward to release from the detents to allow movement of the draincock to its open position while remaining retained in the stepped bore by the retaining arms.

* * * * *